US005999204A

United States Patent [19]

Kojima

[11] Patent Number: 5,999,204

[45] **Date of Patent: *Dec. 7, 1999**

[54] APPARATUS AND METHOD FOR THERMAL IMAGE RECORDING

[75] Inventor: Tetsuya Kojima, Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/799,568

[22] Filed: Feb. 12, 1997

[30] Foreign Application Priority Data

Feb. 13, 1996 [JP] Japan ..... 8-025035

[51] Int. Cl.[6] ..... B41J 2/36

[52] U.S. Cl. ..... 347/194; 347/190

[58] Field of Search ..... 347/190, 194, 347/195, 179, 17; 400/120.7, 120.14

[56] References Cited

U.S. PATENT DOCUMENTS

| | | | |
|---|---|---|---|
| 4,574,293 | 3/1986 | Inui et al. | 324/306 |
| 5,248,995 | 9/1993 | Izumi | 347/180 |
| 5,268,706 | 12/1993 | Sakamoto | 347/180 |
| 5,644,351 | 7/1997 | Matsumoto et al. | 347/194 |

FOREIGN PATENT DOCUMENTS

| | | | |
|---|---|---|---|
| 0 110 675 | 6/1984 | European Pat. Off. | B41J 3/20 |
| 59-98878 | 6/1984 | Japan | B41J 3/20 |
| 63-317351 | 12/1988 | Japan | 347/17 |
| WO 95/01044 | 1/1995 | WIPO | H04N 1/40 |

OTHER PUBLICATIONS

Patent Abstracts of Japan vol. 018, No. 502 (M–1676), Sep. 20, 1994, JP 06 171134 A (Matsushita Electric Ind Co Ltd) Jun. 21, 1994 *Abstract.

Patent Abstracts of Japan vol. 008, No. 002 (M–266), Jan. 7, 1984 JP 58 166075 A (Ricoh KK), Oct. 1, 1983 *Abstract.

Patent Abstracts of Japan, vol. 012, No. 424 (M–761), Nov. 10, 1988 JP 63 159068 A (Matsusushita Electrical Ind Co Ltd) Jul. 1988 *Abstract.

Patent Abstracts of Japan, vol. 009, no. 286 (M–429), Nov. 13, 1985 JP 60 127171 A (Fuji Xerox KK) Jul. 6, 1985 *Abstract.

Patent Abstracts of Japan, vol. 013, No. 514 (M–894), Nov. 17, 1989 JP 01 208158 A (Fujitsu Ltd) Aug. 22, 1989 * Abstract.

*Primary Examiner*—N. Le
*Assistant Examiner*—Anh T. N. Vo
*Attorney, Agent, or Firm*—Sughrue, Mion, Zinn Macpeak & Seas, PLLC

[57] ABSTRACT

The improved thermal image recording method for forming an image to be recorded corresponding to image data on a thermal recording material using a thermal head, includes the steps of dividing the image to be recorded on one screen into a specified number of regions each having a specified number of pixels and calculating for each of the regions a representative value of the image data within that region; calculating a predicted value of temperature for each of the regions from the representative value of the image data within that region and an initial value of temperature as detected with a specified number of thermistors; calculating a value of temperature correction for each of the regions from the predicted value of temperature for that region; interpolating the values of temperature correction for the regions to calculate a value of temperature correction for each of the pixels in the image to be recorded on one screen; and performing temperature compensation on the image data of each of the pixels. The improved thermal recording apparatus carries out the improved thermal recording method described above. These apparatus and method are capable of recording high quality images at high speed without uneven densities.

8 Claims, 7 Drawing Sheets

APPARATUS AND METHOD FOR THERMAL IMAGE RECORDING

BACKGROUND OF THE INVENTION

This invention relates to a thermal image recording apparatus with which a recording corresponding to image data is formed on a thermal recording material (hereunder referred to as a "thermal material") using a thermal head. The invention also relates to a recording method for application of that apparatus. More specifically, the invention relates to a thermal image recording apparatus and method which are capable of forming recording at high speed without uneven densities.

Thermal materials comprising a thermal recording layer on a substrate such as a paper or film are commonly used to record the images produced in diagnosis by ultrasonic scanning. This recording method, commonly referred to as thermal image recording, eliminates the need for wet processing and offers several advantages including convenience in handling. Hence, the use of the thermal image recording system is not limited to small-scale applications such as diagnosis by ultrasonic scanning and an extension to those areas of medical diagnoses such as CT, MRI and X-ray photography where large and high-quality images are required, is under review.

As is well known, the thermal image recording apparatus uses a thermal head having a glaze in which heat generating resistors corresponding to the number of pixels of one line are arranged in one direction and, with the glaze slightly pressed against the thermal recording layer of the thermal material, the two members are moved relative to each other in a direction approximately perpendicular to the direction in which the heat generating resistors are arranged, and the respective heat generating resistors of the glaze are heated in accordance with the image to be recorded to heat the thermal recording layer imagewise, thereby accomplishing image reproduction.

A typical method of heating the individual heat generating resistors is by applying an electric current to such resistors for specified time periods that correspond to the image data of the individual pixels in the image to be recorded. However, the temperatures of the heat generating resistors to be energized vary from each other depending on the history of heat generation up to the previous line and, therefore, even if the heat generating resistors corresponding to the pixels having the same image data in the present line are energized for the same time period, temperature differences will occur between the heated resistors, thereby producing unevenness in the recording density.

In order to solve this problem of uneven recording densities, the image data must be compensated for temperature such that the heat generating temperature for the image data are corrected for each heat generating resistor on the basis of that image data and the history of heat generation up to the previous line.

Unexamined Published Japanese Patent Application 59 -98878 teaches a thermal recording apparatus capable of outputting images at consistent density during high-speed recording. This apparatus performs thermal transfer recording using an ink ribbon and comprises memory means for storing the quantity of energy stored in each of the heat generating resistors, first computing means by which the electric energy to be applied to each of the heat generating resistors is calculated on the basis of the output data from said memory means and the input image data, second computing means by which the electric energy stored in each of the heat generating resistors is calculated on the basis of the output data from the memory means and the input image data, and control means by which the quantity of the electric energy to be applied to each of the heat generating resistors is controlled in accordance with the output of the first computing means.

In the above thermal recording apparatus, the electric energy to be applied at the present time is calculated on the basis of the image data to each of the heat generating resistors and the quantity of the heat stored up to the present time, namely, the past image data weighted to have a progressively smaller value back into the past; therefore, according to the patent, the calculated results reflect the changes in the temperatures of the individual heat generating resistors more correctly and, compared to the conventional system, the apparatus can provide more uniform recording densities, which is an advantage particularly salient in a high-speed recording mode.

In fact, however, the apparatus is designed to be such that the electric energy to be applied to the heat generating resistor corresponding to each one of the pixels is calculated for the entire surface of one screen, so that quite a lot of time is required to calculate the electric energy of interest. Therefore, if the size of one screen increases or if the number of recording pixels is increased in order to meet the demand for producing images of higher quality, it becomes difficult to achieve high-speed recording with this apparatus. If a capability for high-speed calculation is needed, the system configuration must be made complex enough which increases the manufacturing cost.

SUMMARY OF THE INVENTION

The present invention has been accomplished under these circumstances and has as an object providing a thermal image recording apparatus that has a compact and low-cost system configuration and which yet is capable of forming recording of high image quality without uneven densities.

Another object of the invention is to provide a recording method applicable to that apparatus.

To achieve the above object, the invention provides a thermal image recording apparatus with which an image to be recorded corresponding to image data is formed on a thermal recording material using a thermal head, said apparatus having an image processing unit which comprises:

- means by which the image to be recorded on one screen is divided into a specified number of regions each having a specified number of pixels and which calculates for each of said regions a representative value of the image data within that region;
- means for calculating a predicted value of temperature for each of said regions from said representative value of the image data within that region and an initial value of temperature as detected with a specified number of thermistors;
- means for calculating a value of temperature correction for each of said regions from said predicted value of temperature for that region; and
- means by which the values of temperature correction for said regions is interpolated to calculate a value of temperature correction for each of the pixels in said image to be recorded on one screen and by which the image data of each of said pixels are compensated for temperature.

The invention also provides a thermal image recording method for forming an image to be recorded corresponding to image data on a thermal recording material using a thermal head, said method comprising the steps of:

dividing the image to be recorded on one screen into a specified number of regions each having a specified number of pixels and calculating for each of said regions a representative value of the image data within that region;

calculating a predicted value of temperature for each of said regions from said representative value of the image data within that region and an initial value of temperature as detected with a specified number of thermistors;

calculating a value of temperature correction for each of said regions from said predicted value of temperature for that region;

interpolating the values of temperature correction for said regions to calculate a value of temperature correction for each of the pixels in said image to be recorded on one screen; and performing temperature compensation on the image data of each of said pixels.

It is preferred that said representative value of the image data within each of said regions is either the image data corresponding to a specified pixel within that region or an average value of the image data corresponding to a specified number of pixels within that region or an average value of the image data corresponding to all pixels within that region.

It is also preferred that said specified number of thermistors are disposed in specified positions on said thermal head and are adapted to be such that if either one of thermistors fails, an initial value of temperature to be detected with the failing thermistor is replaced by either an initial value of temperature as detected with a nearby thermistor or a value obtained by interpolating initial values of temperature as detected with the thermistors on the two adjoining sides of the failing thermistor.

It is further preferred that the predicted value of temperature for each of said regions is calculated on the basis of an electrically equivalent CR circuit model (hereunder referred to as CR model) of the thermal head.

The thermal image recording apparatus and method of the invention are characterized by the following: the image to be recorded on one screen is divided into a specified number of regions each having a specified number of pixels; the value of temperature correction is calculated for each of these regions; and the values of temperature correction for the respective regions are interpolated to calculate the value of temperature correction for each of the pixels in the image to be recorded on one screen.

Therefore, using the thermal image recording apparatus and method of the invention, one can not only produce records without uneven image densities but also form recorded images of high quality at high speed.

DETAILED DESCRIPTION OF THE INVENTION

The thermal image recording apparatus and method of the invention will now be described in detail with reference to the preferred embodiments shown in the accompanying drawings.

Figure 1:
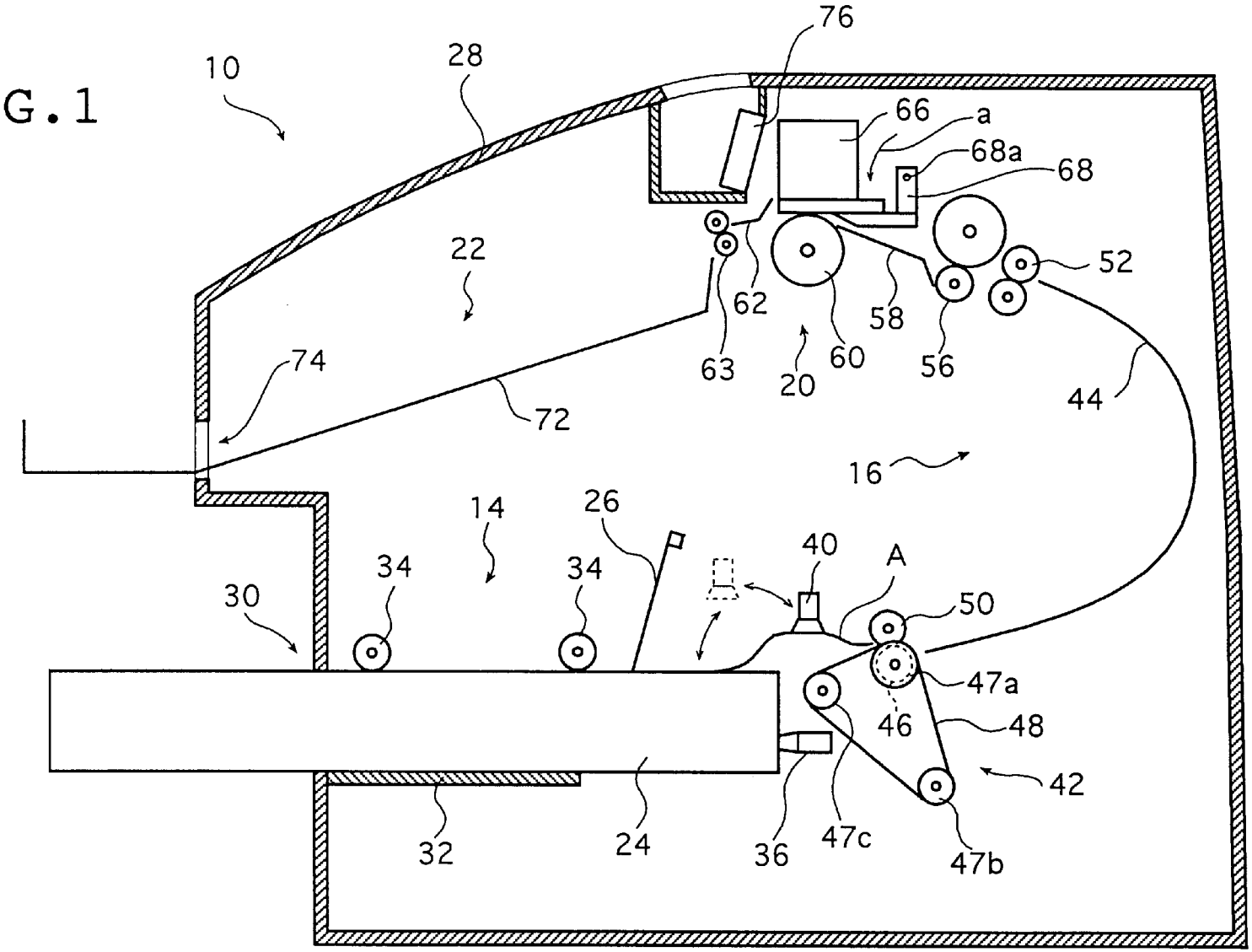
FIG. 1 is a diagram showing the concept of an example of the thermal image recording apparatus of the invention.

FIG. 1 shows schematically an example of the thermal image recording apparatus of the invention. The thermal image recording apparatus generally indicated by 10 in FIG. 1 and which is hereunder simply referred to as a "recording apparatus" performs thermal image recording on thermal recording materials of a given size, say, B4 (namely, thermal recording materials in the form of cut sheets). The apparatus comprises a loading section 14 where a magazine 24 containing thermal films A are loaded, a feed/transport section 16, a recording section 20 performing thermal image recording on thermal films A by means of the thermal head 66, and an ejecting section 22.

The thermal films A comprise respectively a substrate consisting of a transparent film such as a transparent polyethylene terephthalate (PET) film, which is overlaid with a thermal recording layer.

Typically, such thermal films A are stacked in a specified number, say, 100 to form a bundle, which is either wrapped in a bag or bound with a band to provide a package. As shown, the specified number of thermal films A bundled together with the thermal recording layer side facing down are accommodated in the magazine 24 of the recording apparatus 10, and they are taken out of the magazine 24 one by one to be used for thermal image recording.

The loading section 14 has an inlet 30 formed in the housing 28 of the recording apparatus 10, a guide plate 32, guide rolls 34 and a stop member 36.

The magazine 24 is a case having a cover 26 which can be freely opened, and is inserted into the recording apparatus 10 via the inlet 30 of the loading section 14 in such a way that the portion fitted with the cover 26 is inserted first; thereafter, the magazine 24 as it is guided by the guide plate 32 and the guide rolls 34, is pushed until it contacts the stop member 36, whereupon it is loaded at a specified position in the recording apparatus 10.

The feed/transport section 16 has the sheet feeding mechanism using the sucker 40 for grabbing the thermal film A by application of suction, transport means 42, a transport guide 44 and a regulating roller pair 52 located in the outlet of the transport guide 44. The thermal films A are taken out of the magazine 24 in the loading section 14 and transported to the recording section 20.

The transport means 42 is composed of a transport roller 46, a pulley 47*a* coaxial with the roller 46, a pulley 47*b* coupled to a rotating drive source, a tension pulley 47*c*, an endless belt 48 stretched between the three pulleys 47*a*, 47*b* and 47*c*, and a nip roller 50 that is to be pressed onto the transport roller 46.

When a signal for the start of recording is issued, the cover 26 is opened by the OPEN/CLOSE mechanism (not shown) in the recording apparatus 10. Then, the sheet feeding mechanism using the sucker 40 picks up one sheet of thermal film A from the magazine 24 and feeds the forward end of the sheet to the transport means 42 (to be nipped between rollers 46 and 50).

At the point of time when the thermal film A has been pinched between the transport roller 46 and the nip roller 50, the sucker 40 releases the film, and the thus fed thermal film A is supplied along the transport guide 44.

At the point of time when the thermal film A to be used in recording has been completely ejected from the magazine 24, the OPEN/CLOSE mechanism closes the cover 26. The distance between the transport means 42 and the regulating roller pair 52 which is defined by the transport guide 44 is set to be somewhat shorter than the length of the thermal film A in the direction of its transport. The advancing end of the thermal film A first reaches the regulating roller pair 52 by the transport means 42. The regulating roller pair 52 are normally at rest. The advancing end of the thermal film A stops here.

When the advancing end of the thermal film A reaches the regulating roller pair 52, the temperature of the thermal head 66 is checked and if it is at a specified level, the regulating roller pair 52 start to transport the thermal film A, which is transported to the recording section 20.

Figure 2:
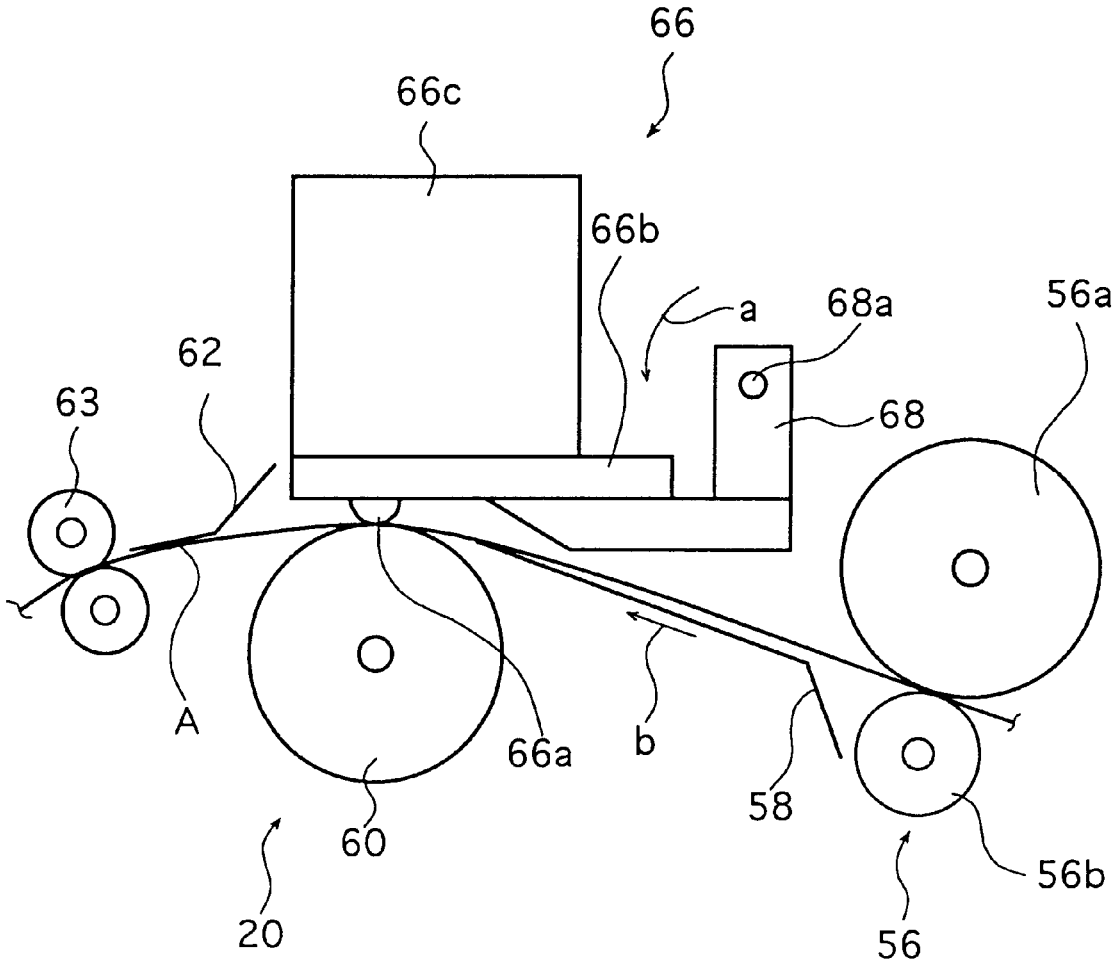
FIG. 2 is a diagram showing the concept of an example of the recording section of the thermal image recording apparatus of the invention.

FIG. 2 shows schematically the recording section 20. As shown, the recording section 20 has the thermal head 66, a platen roller 60, a roller pair 56, (56*a* and 56*b*) a guide 58, a fan 76 for cooling the thermal head 66 (see FIG. 1, not shown in FIG. 2), a guide 62, and a transport roller pair 63.

As shown, the thermal head 66 is capable of thermal recording at a recording (pixel) density of, say, about 300 dpi. The head comprises a ceramic substrate 66*b* having a glaze 66*a* in which the heat generating resistors performing one line thermal recording on the thermal film A are arranged in one direction (perpendicular to the paper of FIG. 2), and a heat sink 66*c* fixed to the ceramic substrate 66*b*. The thermal head 66 is supported on a support member 68 that can pivot about a fulcrum 68*a* either in the direction of arrow a or in the reverse direction.

The platen roller 60 rotates at a specified image recording speed while holding the thermal film A in a specified position, and transports the thermal film A in the direction (direction of arrow b in FIG. 2) approximately perpendicular to the direction in which the glaze 66*a* extends.

Before the thermal film A is transported to the recording section 20, the support member 68 has pivoted to the UP position (in the direction opposite to the direction of arrow a) so that the glaze 66*a* of the thermal head 66 is not in contact with the platen roller 60.

When the transport of the thermal film A by the regulating roller pair 52 starts, said film A is subsequently pinched between the rollers 56 and transported as it is guided by the guide 58.

When the advancing end of the thermal film A has reached the record START position (i.e., corresponding to the glaze 66*a*), the support member 68 pivots in the direction of arrow a and the thermal film A becomes pinched between the glaze 66*a* on the thermal head 66 and the platen roller 60 such that the glaze 66*a* is pressed onto the recording layer while the thermal film A is transported in the direction of arrow b by means of the platen roller 60, the regulating roller pair 52 and the transport roller pair 63 as it is held in a specified position by the platen roller 60.

During this transport, the individual heat generating resistors on the glaze 66*a* are actuated imagewise to perform thermal image recording on the thermal film A. After the end of thermal image recording, the thermal film A as it is guided by the guide 62 is transported by the platen roller 60 and the transport roller pair 63 to be ejected into a tray 72 in the ejecting section 22. The tray 72 projects exterior to the recording apparatus 10 via the outlet 74 formed in the housing 28 and the thermal film A carrying the recorded image is ejected via the outlet 74 for takeout by the operator.

We now describe the method for performing thermal image recording with the above-described apparatus of the invention.

Figure 3:
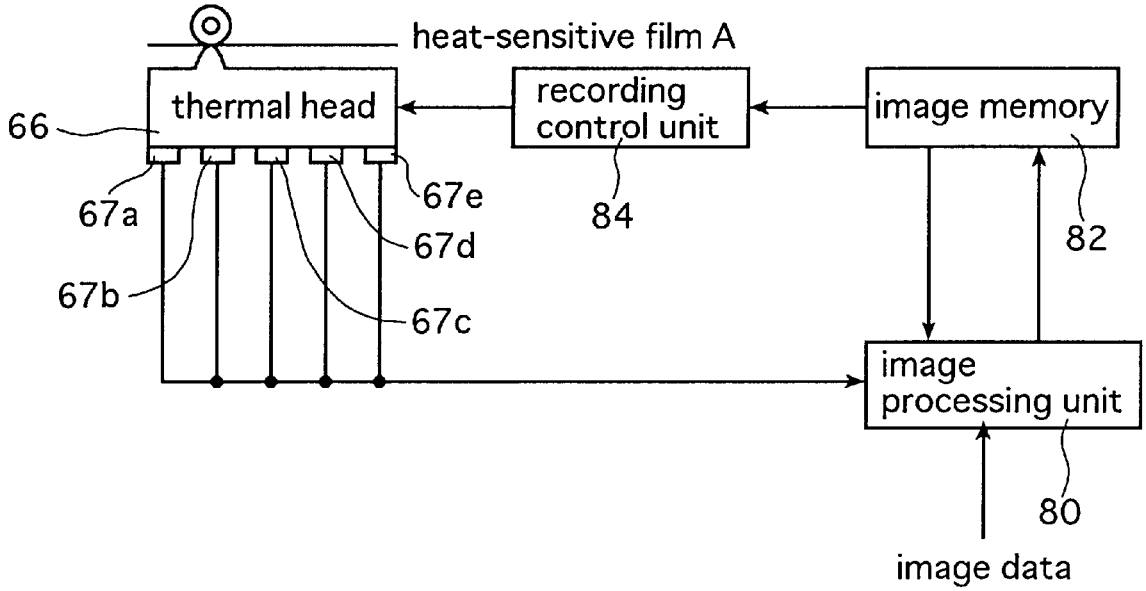
FIG. 3 is a block diagram of an exemplary system for processing image data to the thermal image recording apparatus of the invention.

FIG. 3 is a block diagram of an exemplary system for processing image data to the thermal image recording apparatus of the invention.

As shown, the image data supplied to an image processing unit 80 are subjected to temperature correction and various other image processing jobs on the basis of thermistors 67*a*, 67*b*, 67*c*, 67*d* and 67*e*, as well as thermistors (not shown) for detecting the temperature of the heat sink and the ambient temperature and the thus processed image data are stored in an image memory 82. On the basis of the stored image data, a recording control unit 84 controls the heat generation by the individual heat generating resistors on the glaze 66*a* of the thermal head 66.

Figure 4:
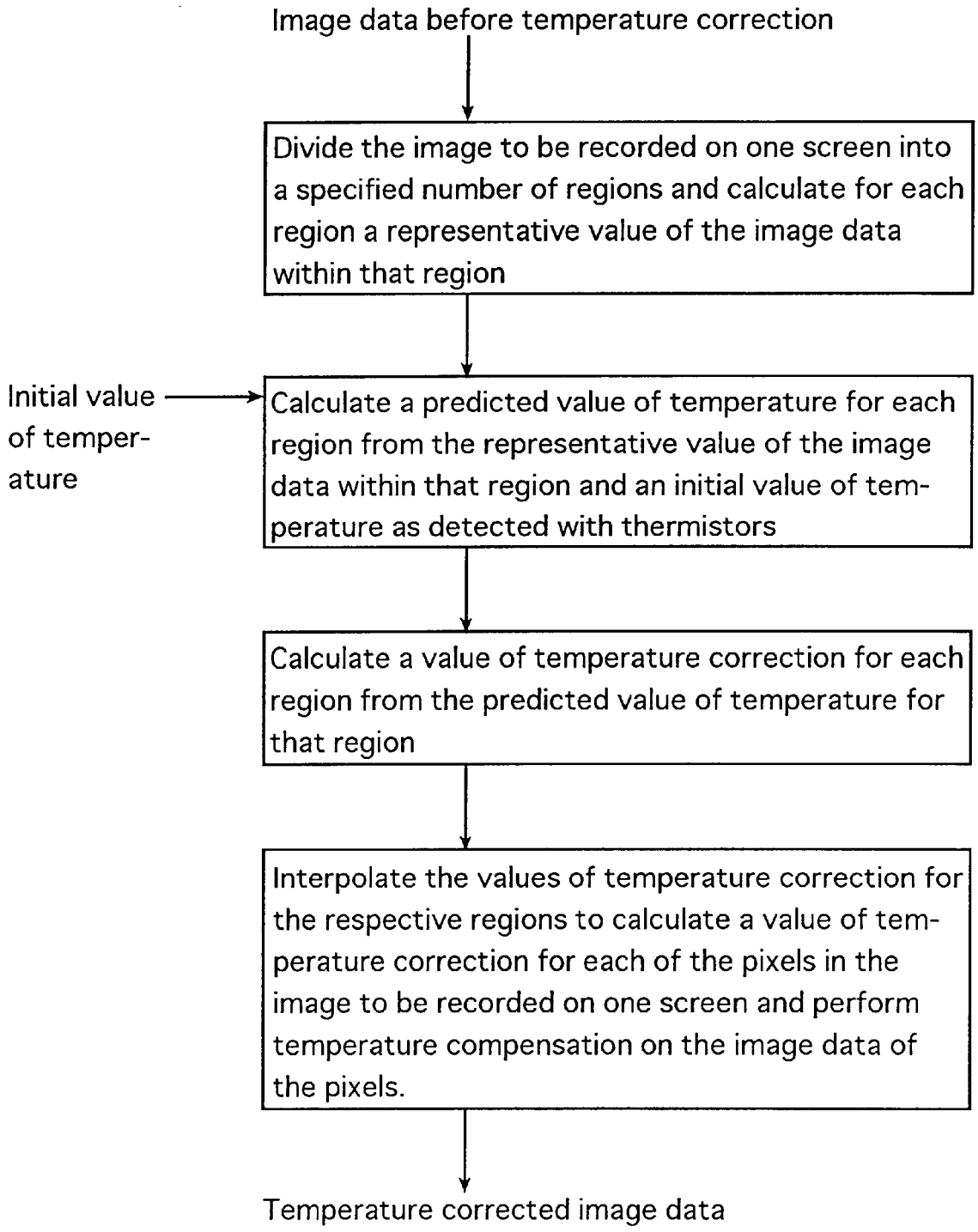
FIG. 4 is a flowchart for the steps that are performed in an example of the image processing unit of the system for processing image data to the thermal image recording apparatus of the invention.

FIG. 4 is a flowchart for the steps that are performed in an example of the image processing unit 80. As shown in the Figure, prior to the image recording with the thermal head 66, the image to be recorded on one screen is divided into a specified number of regions each having a specified number of pixels and the image data within each region are subsampled to calculate a representative value for that image data. The representative value for the image data within each region may be the image data corresponding to a specified pixel in that region, or the average of the image data corresponding to a specified number of pixels in that region, or the average of the image data corresponding to all pixels in that region.

Figure 5:
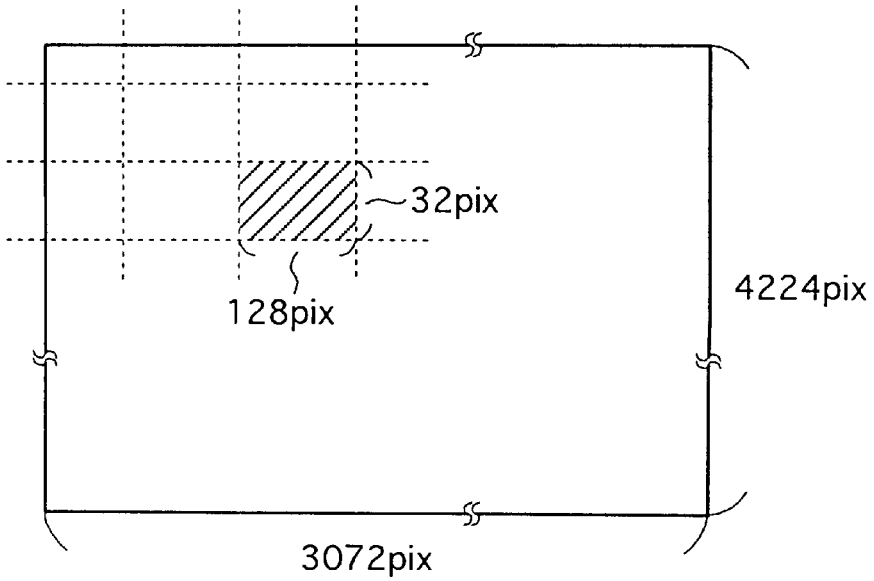
FIG. 5 is a diagram showing the concept of an example of the image to be recorded by the thermal image recording method of the invention which has been divided into a specified number of regions each having a specified number of pixels.

Consider, for example, the case where the image to be recorded on one screen consists of 3072 pixels in the horizontal direction and 4224 pixels in the vertical direction and said image is divided into a grid pattern of 25×133 regions each consisting of 128×32 pixels, as shown in FIG. 5. It should be noted that this is just one example and the number of pixels in the image to be recorded on one screen and the number of pixels in each of the regions into which said image is divided or the number of such regions are not limited to any particular values. It should also be understood that regions which do not have 128×32 pixels may be present along the edges of the screen as in the case shown in FIG. 5.

If the image data corresponding to one pixel in each of the regions into which the image to be recorded on one screen has been divided is to be taken as a representative value for the image data within that region, said representative value M(i,j) may be calculated in the illustrated case by the following formula:

$$M(i,j)=D(i\times128,\ j\times32)$$

where i and j are the coefficients representing the region numbers in the horizontal and vertical directions, respectively, such that i is an integer satisfying the relation $0\leqq i\leqq24$ and that i is an integer satisfying the relation $0\leqq j\leqq132$; D represents the image data corresponding to the pixels in the image to be recorded on one screen and, in the illustrated case, it is within the range of from D(0,0) to D(3071,4223).

If the average of the image data corresponding to a certain number of pixels, say, four pixels in each region is taken as a representative value for the image data in that region, said representative value M(i,j) for the image data D may be calculated by the following formula:

$$M(i,j)=\{D(i\times128-32,\ j\times32-8)+D(i\times128-32,\ j\times32+8)+D(i\times128+32,\ j\times32-8)+D(i\times128+32,\ j\times32+8)\}/4$$

If the average of the image data corresponding to all pixels in each region, namely, 128×32 pixels is taken as a representative value for the image data in that region, said representative value M(i,j) for the image data D may be calculated by averaging the image data D for the region surrounded by the following points:

D(i×128−64, j×32−16)

D(i×128−64, j×32+15)

D(i×128+63, j×32−16)

D(i×128+63, j×32+15)

In the illustrated case, the image data D for one screen are within the range from D(0,0) to D(3071,4223), so if the image data D calculated by either one of the formulae set forth above are outside the stated range, the representative value for the image D in each region may be calculated on the assumption that D=0. Needless to say, the precision of the correction is best improved if the average of the image data D corresponding to all pixels in each region is used as the representative value for that image data D.

In the next step, the image processing unit 80 calculates a predicted value of temperature $V_g$(i,i) for each region on the basis of both the representative value M(i,j) for the image data D within that region and the initial value of temperature which is detected with, for example, thermistors 67*a*, 67*b*, 67*c*, 67*d* and 67*e* provided in specified positions on the thermal head 66 and thermistors (not shown) for detecting the temperature $T_h$ of heat sink 66*c* and the ambient temperature $T_a$.

Before describing a specific example of the method of calculating the predicted value of temperature for each region, let us briefly discuss the basic construction of the thermal head used in the thermal image recording apparatus of the invention.

Figure 6:
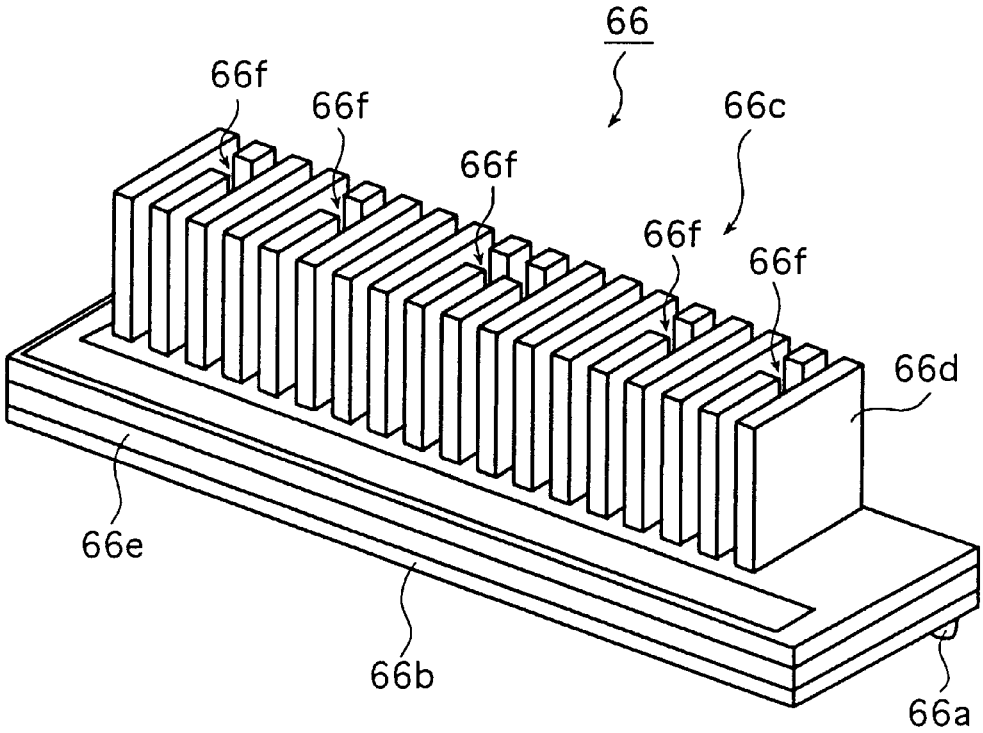
FIG. 6 is a perspective view of an exemplary thermal head for use in the thermal image recording apparatus of the invention.
Figure 7:
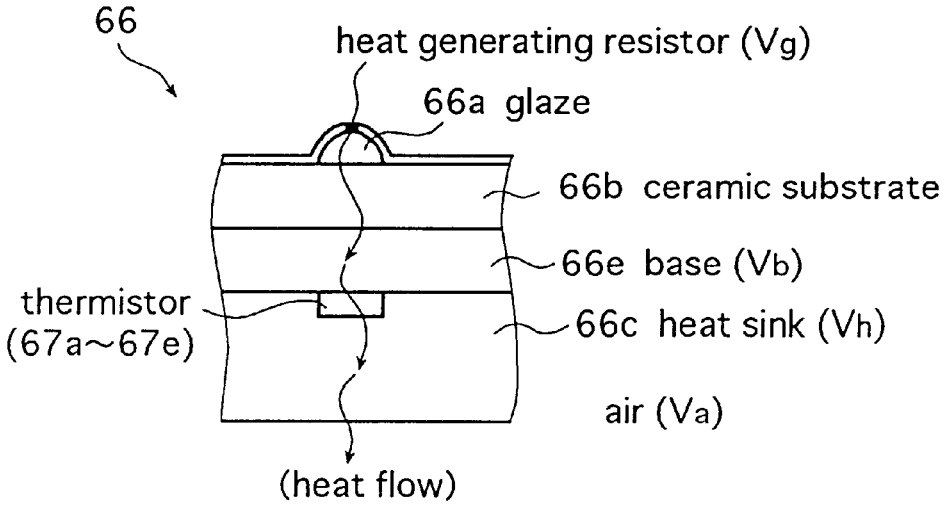
FIG. 7 is a cross section of the thermal head shown in FIG. 6.

FIGS. 6 and 7 are a perspective view and a cross section, respectively, of an exemplary thermal head. The thermal head generally indicated by 66 comprises the ceramic substrate 66*b* with the glaze 66*a*, a base 66*e* which is a metallic (e.g. aluminum) plate superposed on the ceramic substrate 66*b* on the side remote from the glaze 66*a*, and the heat sink 66*c* that is superposed on the opposite side of the base 66*e* and which has a plurality of heat dissipating fins 66*d*.

In the illustrated thermal head 66, the heat dissipating fins 66*d* of the heat sink 66*c* have five cutouts 66*f* formed in specified positions, and thermistors 67*a*, 67*b*, 67*c*, 67*d* and 67*e* for detecting the temperature of the thermal head 66 (see FIG. 3) are installed within the respective cutouts 66*f*. The heat generating resistors are formed at the tip of the glaze 66*a* and, as FIG. 7 shows, the heat generated by the resistors is transmitted through the glaze 66*a*, ceramic substrate 66*b* and base 66*e* in that order until it is dissipated from the fins 66*d* of the heat sink 66*c*.

This is the basic construction of the thermal head 66 for use in the thermal image recording apparatus of the invention. Needless to say, this is just one example of the thermal head design and will in no way limit the thermal image recording apparatus of the invention.

The method of calculating the predicted value of temperature for each of the regions into which the image to be recorded on one screen has been divided will now be described assuming that the heat transmission system of the thermal head 66 is likened to an electric equivalent circuit of a CR model consisting of a capacitance component C and a resistance component R. In the equivalent circuit discussed below, the quantity of the heat generated by the heat transmission system per unit time, the temperature, the heat capacity and the heat resistance are replaced by the current, voltage, capacitance and resistance of an equivalent electric system.

Figure 8:
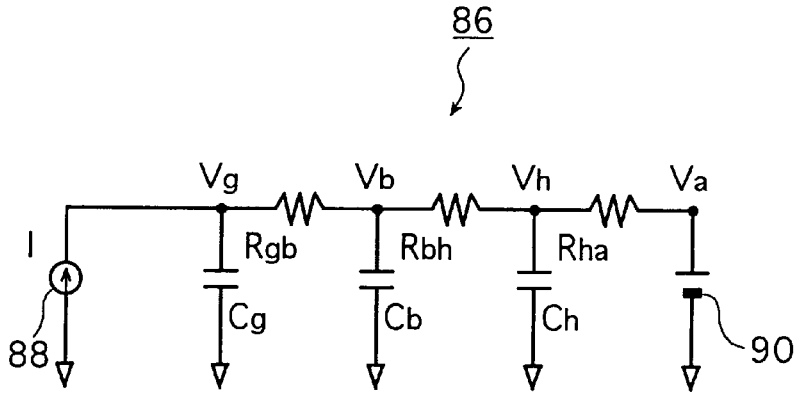
FIG. 8 shows a circuit diagram of an example of the electrically equivalent CR model for a cross section of the thermal head in the thermal image recording apparatus of the invention.

FIG. 8 shows a circuit diagram of an example of the electrically equivalent CR model for a cross section of the thermal head. The equivalent circuit generally indicated by 86 includes a constant-current source 88 and a constant-voltage source (dry cell) 90 such that the quantity of the heat generated by each heat generating resistor is controlled to be constant and likened to the generation of a constant current I whereas the ambient temperature $T_a$ is controlled to be constant and likened to the generation of a constant voltage $V_a$; in addition to these elements, the capacitance component C and resistor component R associated with the glaze 66*a*, base 66*e* and heat sink 66*c* are used to represent by a CR model the cross-sectional structure of one of the heat generating resistors in the thermal head 66 shown in FIG. 7.

In the illustrated equivalent circuit 86, the capacitance components of the glaze 66*a*, base 66*e* and heat sink 66*c* are designated by $C_g$, $C_b$ and $C_h$, respectively and, similarly, the resistance components between glaze/base, base/heat sink and heat sink/ambient air are designated by $R_{gb}$, $R_{bh}$ and $R_{ha}$, respectively. The voltages at the glaze 66*a*, base 66*e*, heat sink 66*c* and in the ambient air are designated by $V_g$, $V_b$, $V_h$ and $V_a$, respectively.

As already mentioned, the heat generated by the heat generating resistors is transmitted from the glaze 66*a* through base 66*e* and heat sink 66*c* to the ambient air after the lapse of a certain time. This may be likened to the following phenomenon in the equivalent circuit 86: the current I generated by the constant-current source 88 is delayed by a specified time corresponding to the CR time constant which is determined by the capacitance component $C_g$ of the glaze 66*a* and the resistance component $R_{gb}$ between the glaze 66*a* and the base 66*e* and, thereafter, the current I flows out of the constant-current source 88 past the glaze 66*a* to reach the base 66*e*, from which it flows through the heat sink 66*c* to reach the ambient air in the same manner as in the actual thermal head.

Figure 9:
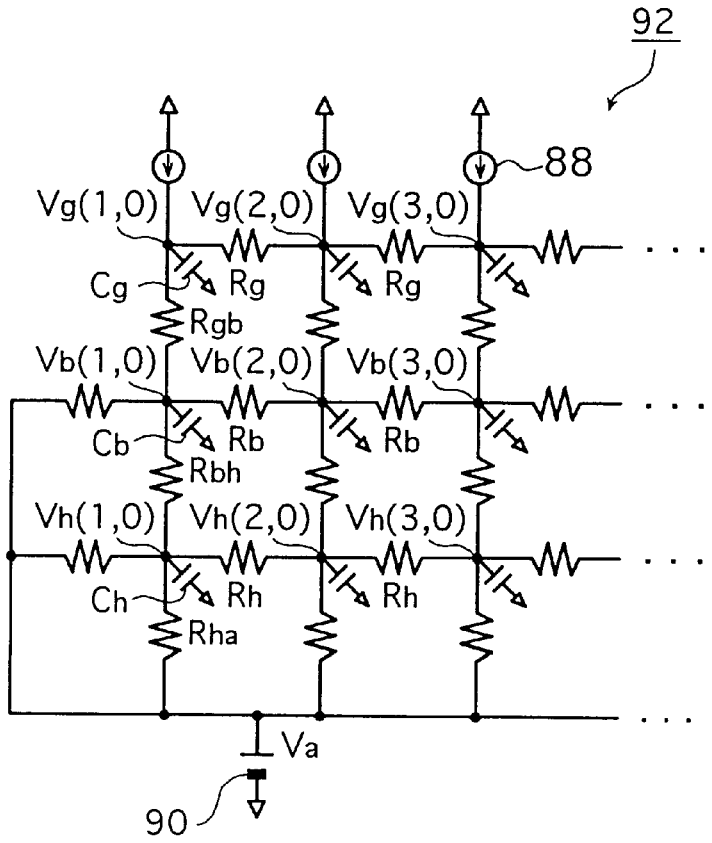
FIG. 9 shows a partial circuit diagram of an example of the electrically equivalent CR model for the entire portion of the same thermal head.

FIG. 9 shows a circuit diagram for a CR model of the entire design of the thermal head 66 (see FIG. 6) that is constructed using the equivalent circuit 86 shown in FIG. 8. In the equivalent circuit generally indicated by 92 in FIG. 9, the resistance component between the glazes 66*a* of adjacent heat generating resistors is designated as $R_g$ and, similarly, the resistance component between bases 66*e* is designated as $R_b$ and the resistance component between heat sinks 66*c* as $R_h$. The voltages at the individual glaze 66*a*, base 66*e* and heat sink 66*c* are designated as $V_g(i,i)$, $V_b(i,j)$ and $V_h(i,j)$, respectively.

Assuming that the image to be recorded on one screen is divided into 25×133 regions as shown in FIG. 5, we now describe the method of calculating the predicted value of temperature $V_g(i,i)$ of each region using the equivalent circuit 92 as a CR model of the thermal head.

First, the initial values of temperature $T_1$, $T_2$, $T_3$, $T_4$ and $T_5$ to be detected by thermistors 67*a*, 67*b*, 67*c*, 67*d* and 67*e* are set as the initial values of the voltage $V_g$ at the glaze 66*a* and the voltage $V_b$ at the base 66*e*; in addition, the initial value of temperature $T_h$ of heat sink 66*c* is set as the initial value of the voltage $V_h$ at the heat sink 66*c*. As for the voltage $V_a$ in the ambient air, the ambient air temperature $T_a$ is set at a fixed value. The initial values of $V_g$ at the glaze 66*a*, $V_b$ at the base 66*e* and $V_h$ at the heat sink 66*c*, as well as the voltage $V_a$ in the ambient air may be calculated by the following formulae:

$$\begin{aligned} V_g(i,0) &= V_b(i,0) \\ &= T_1(\text{when } i=3) \\ &= T_2(\text{when } i=7) \\ &= T_3(\text{when } i=12) \\ &= T_4(\text{when } i=17) \\ &= T_5(\text{when } i=21) \\ V_h(i,0) &= T_h \quad (0 \le i \le 24) \\ V_a &= T_a \end{aligned}$$

If i takes on the values other than those indicated above, the initial values of $V_g$ at the glaze 66*a* and $V_b$ at the base 66*e* are calculated and set by linear interpolation of the initial values of temperature $T_1$, $T_2$, $T_3$, $T_4$ and $T_5$ which have been detected with the thermistors 67*a*, 67*b*, 67*c*, 67*d* and 67*e*, respectively. In the case under discussion where the thermal head 66 has a plurality of thermistors, if one of them fails, the initial value of the temperature as detected by a nearby thermistor may be substituted or the initial values of the temperature as detected by the thermistors on the two adjoining sides of the failing thermistor may be subjected to linear interpolation to calculate the initial value of the temperature which is to be detected with the failing thermistor.

Then, the predicted value of temperature $V_g(i,j)$ for each region may be calculated by the following formulae:

$$V_g(i,j+1)=V_g(i,j)+(kI+V_{g1}+V_{g2})/Cg$$

$$V_{g1}=\{V_g(i+1,j)-2V_g(i,j)+V_g(i-1,j)\}/R_g$$

$$V_{g2}=\{V_b(i,j)-V_g(i,j)\}/R_{gb}$$

$$V_b(i,j+1)=V_b(i,j)+(V_{b1}+V_{b2}+V_{b3})/C_b$$

$$V_{b1}=\{V_b(i+1,j)-2V_b(i,j)+V_b(i-1,j)\}/R_b$$

$$V_{b2}=\{V_g(i,j)-V_b(i,j)\}/R_{gb}$$

$$V_{b3}=\{V_h(i,j)-V_b(i,j)\}/R_{bh}$$

$$V_h(i,j+1)=V_h(i,j)+(V_{h1}+V_{h2}+V_{h3})/C_h$$

$$V_{h1}=\{V_h(i+1,j)-2V_h(i,j)+V_h(i-1,j)\}/R_h$$

$$V_{h2}=\{V_b(i,j)-V_h(i,j)\}/R_{bh}$$

$$V_{h3}=\{V_a-V_h(i,j)\}/R_{ha}$$

In the calculation formulae set forth above, k is a proportionality constant, i is an integer satisfying the relation $0 \leqq i \leqq 24$ and i is an integer satisfying $0 \leqq j \leqq 131$, provided that i−1=0 if i=0 and that i+1=24 if i=24, and I is the current generated from the constant-current source, namely, the quantity of the heat generated by an individual heat generating resistor and, specifically, the representative value M(i, j) of the image data D within each region is substituted into I.

The foregoing is an example of the method for calculating the predicted value of temperature $V_g(i,j)$ in the image processing unit 80.

In the next step, the image processing unit 80 calculates the value of temperature correction K(i,j) for each region from the thus calculated predicted value of temperature $V_g(i,j)$ of that region. An exemplary formula for making this calculation is:

$$K(i,j)=b\ 1-K_m\{V_g(i,j)-V_s\}$$

where $K_m$ and $V_s$ are both proportionality constants, with $K_m$ typically taking a real number on the order of 0.001–0.03.

Figure 10:
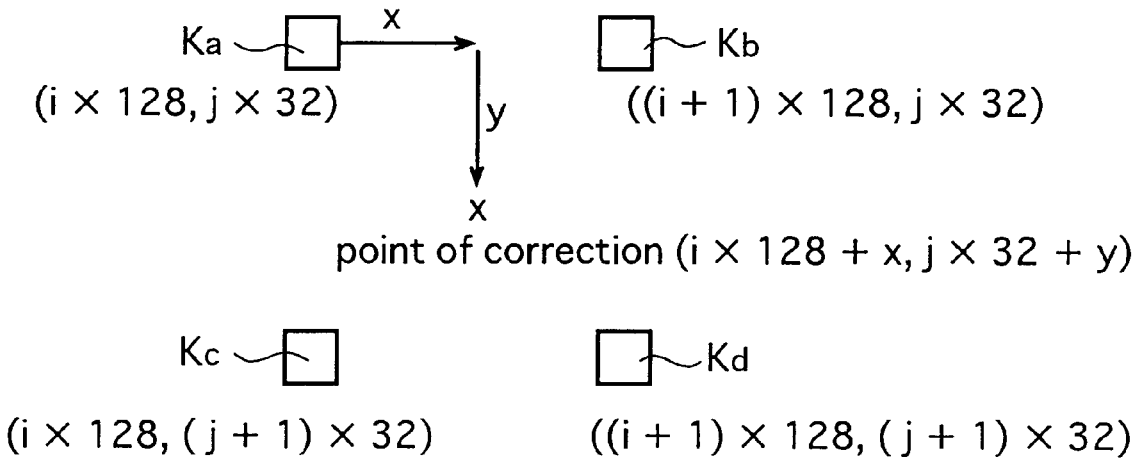
FIG. 10 is a diagram showing an exemplary method of calculating the value of temperature correction for each pixel in the thermal image recording apparatus of the invention.

Finally, the image processing unit 80 interpolates the values of temperature correction K(i,j) for the respective regions of interest such as to calculate the value of temperature correction $K_p$ for each of the pixels in the image to be recorded on one screen. Consider, for example, the case shown in FIG. 10 which assumes the following four regions for which the value of temperature correction K(i,j) has been calculated:

$$K_a=K(i,j)$$

$$K_b=K(i+1,j)$$

$$K_c=K(i,j+1)$$

$$K_d=K(i+1,j+1)$$

If $\Delta ca=(K_c-K_a)/32$ and $\Delta db=(K_d-K_b)/32$, the value of temperature correction $K_p$ for the pixel located at the point distant from $K_a$ by (x,y) may be calculated by the following formula:

$$K_p(i\times128+x,\ j\times32+y)=(K_a+\Delta db\times y)+\{(K_b+\Delta db\times y)-(K_a+\Delta ca\times y)\}\times x/128$$

Hence, the temperature corrected image data D' can be calculated by the following formula:

$$D'(i\times128+x,j\times32+y)=K_p(i\times128+x,j\times32+y)\times D(i\times128+x,j\times32+y)$$

Thus, the image processing unit 80 calculates the value of temperature correction $K_m$ for each of the pixels in the image to be recorded on one screen, calculates the image data as temperature corrected by $K_m$, and writes the corrected data into the image memory 82. Thereafter, the recording control unit 84 uses the temperature corrected image data to control the heat generation by the individual heat generating resistors in the glaze 66*a* on the thermal head 66. This is the way an image is recorded on one screen by means of the thermal head 66.

The thermal image recording apparatus and method of the invention have the basic design and operational features described above.

While the specific design of the image processing unit 80 is not limited in any particular way, the value of temperature correction for each of the pixels in the image to be recorded on one screen may be calculated by either a software or hardware based method. The foregoing description is directed to the case of using a CR model to calculate the values of temperature correction but this is not the sole case of the invention. It should also be noted that even in the case of employing a CR model, the model need not be applied to each of the glaze, base and heat sink taken separately but various modifications may of course be effected according to the design of the thermal head to be used or the desired precision in correction.

As described above in detail, the thermal image recording apparatus and method of the invention are characterized in that the image to be recorded on one screen is divided into a specified number of regions each consisting of a specified number of pixels, the value of temperature correction is calculated for each of said regions and, subsequently, the values of temperature correction for the respective regions are interpolated to calculate the value of temperature correction for each of the pixels of interest. As a result, the values of temperature correction for the pixels in the image to be recorded can be calculated at a sufficiently high speed to ensure that images of high quality without uneven densities can be recorded at high speed. In addition to this obvious advantage, the present invention is capable of providing a low-cost and compact recording apparatus that can be easily adapted to the image recording in the future which requires even higher image quality and a huge amount of data storage.

What is claimed is:

1. A thermal image recording apparatus with which an image to be recorded corresponding to image data is formed on one screen of a thermal recording material using a thermal head having a predetermined number of heat generating resistors corresponding to a predetermined first number of pixels to be recorded in one line on said screen of the thermal recording material, said resistors being disposed in one direction, said apparatus comprising:

an image processing unit operative to:

divide the image to be recorded on said screen into a predetermined number of regions each containing a predetermined second number of pixels disposed in a horizontal direction and a vertical direction, said regions containing a predetermined number of lines on said screen, each of said lines which contains a predetermined third number of pixels;

calculate for each of said regions a representative value of the image data within each of said regions;

calculate a predicted value of temperature for each of said regions from said representative value of the image data within each of said regions and an initial value of temperature as detected with each of said predetermined number of heat-generating resistors;

calculate a value of temperature correction for each of said regions from said predicted value of temperature for each of said regions; and interpolate values of temperature correction for said regions to obtain a value of temperature correction for each of a total number of pixels in said image to be recorded on said screen;

correct the image data of each of said total number of pixels using the value of temperature correction calculated by the image processing unit.

2. The thermal image recording apparatus according to claim 1, wherein said representative value of the image data within each of said regions is at least one of the image data corresponding to a specified pixel of said predetermined second number of pixels within that region, and an average value of the image data corresponding to a predetermined number value of said predetermined second number of pixels within that region, and an average value of the image data corresponding to all of said predetermined second number of pixels within that region.

3. The thermal image recording apparatus according to claim 1, wherein said predetermined number of resistors are disposed in predetermined positions on said thermal head; and wherein a first value of temperature detected with one of said resistors which is a failing resistor is replaced, by at least one of a second value of temperature detected with another of said resistors which is a nearby resistor to said failing resistor, and a value obtained by interpolating a third value of temperature detected with two other resistors of said resistors, the two resistors being on opposite sides of the failing resistor.

4. A thermal image recording method for forming an image to be recorded corresponding to image data formed on one screen of a thermal recording material using a thermal head having a predetermined number of heat generating resistors corresponding to a predetermined first number of pixels to be recorded in one line on said screen of the thermal recording material, said resistors being disposed in one direction, said method comprising the steps of:

dividing the image to be recorded on said screen into a predetermined number of regions each containing a predetermined second number of pixels disposed in a horizontal direction and a vertical direction, said regions containing a predetermined number of lines on said screen, each of said lines which contains a predetermined third number of pixels;

calculating for each of said regions a representative value of the image data within each of said regions;

calculating a predicted value of temperature for each of said regions from said representative value of the image data within each of said regions and an initial value of temperature as detected with each of said predetermined number of resistors;

calculating a value of temperature correction for each of said regions from said predicted value of temperature for each of said regions;

interpolating the values of temperature correction for said regions to obtain a value of temperature correction for each of a total number of pixels in said image to be recorded on said screen; and correcting the image data of each of said total number of pixels using the thus obtained value of temperature correction for each of said total number of pixels.

5. A thermal image recording method for forming an image to be recorded corresponding to image data on a thermal recording material using a thermal head having a predetermined number of heat generating resistors corresponding to pixels to be recorded in one line on one screen of the thermal recording material and arranged in one direction, said method comprising the steps of:

dividing the image to be recorded on one screen into a predetermined number of regions each having a predetermined number of pixels containing a predetermined number of lines on one screen, each line of which contains a predetermined number of pixels;

calculating for each of said regions a representative value of the image data within each of said regions;

calculating a predicted value of temperature for each of said regions from said representative value of the image data within each of said regions and an initial value of temperature as detected with a predetermined number of thermistors;

calculating a value of temperature correction for each of said regions from said predicted value of temperature for each of said regions;

interpolating the values of temperature correction for said regions to obtain a value of temperature correction for each of the pixels in said image to be recorded on one screen; and correcting the image data of each of said pixels using the thus obtained value of temperature correction for each of the pixels.

6. The thermal image recording method according to claim 5, wherein said representative value of the image data within each of said regions is at least one of the image data corresponding to a specified pixel of said predetermined second number of pixels within that region, and an average value of the image data corresponding to a predetermined number value of said predetermined second number of pixels within that region, and an average value of the image data corresponding to all of said predetermined second number of pixels within that region.

7. The thermal image recording method according to claim 5, wherein said predetermined number of resistors are disposed in predetermined positions on said thermal head; and wherein a first value of temperature detected with one of said resistors which is a failing resistor is replaced, by at least one of a second value of temperature detected with another of said resistors which is a nearby resistor to said failing resistor, and a value obtained by interpolating a third value of temperature detected with two other resistors of said resistors, the two resistors being on opposite sides of the failing resistor.

8. A thermal image recording method according to claim 5, wherein the predicted value of temperature for each of said regions is calculated using an electrically equivalent CR circuit model of the thermal head.

* * * * *